US006341468B1

(12) United States Patent
Bigelow

(10) Patent No.: US 6,341,468 B1
(45) Date of Patent: Jan. 29, 2002

(54) BUILDING WITH ATTIC MODULE

(76) Inventor: William H. Bigelow, P.O.Box 7064, Houston, TX (US) 77248

( * ) Notice: Subject to any disclaimer, the term of this patent is extended or adjusted under 35 U.S.C. 154(b) by 0 days.

(21) Appl. No.: 09/564,611

(22) Filed: May 4, 2000

(51) Int. Cl.[7] ..... E04B 1/00; E04G 21/00; E04G 23/00

(52) U.S. Cl. ..... 52/745.13; 52/27; 52/29; 52/79.1; 165/53; 165/48.1; 454/237

(58) Field of Search ..... 52/745.13, 79.1, 52/27, 29; 454/237; 165/53, 48.1

(56) References Cited

U.S. PATENT DOCUMENTS 373,946 A 11/1887 Richardson
3,196,773 A * 7/1965 Lorenz et al. ..... 52/79.1
4,254,822 A * 3/1981 Geier ..... 165/48
4,327,529 A 5/1982 Bigelow, Jr. et al. ..... 52/34
4,364,206 A 12/1982 Wybauw ..... 52/79.7
5,491,934 A 2/1996 Bigelow, Jr. et al. ..... 52/79.5
5,864,992 A 2/1999 Bigelow ..... 52/90.1

* cited by examiner

*Primary Examiner*—Carl D. Friedman
*Assistant Examiner*—Chi Nguyen
(74) *Attorney, Agent, or Firm*—Guy McClung

(57) ABSTRACT

A prefabricated building has been invented having a plurality of exterior walls joined together, a roof structure overlaying an interior space defined by the plurality of walls, an attic under the roof structure, the attic having an attic floor, at least one rail system on the attic floor, an opening in the prefabricated building located for accessing the at least one rail system, and at least one module insertable through the opening, disposable on the rail system, and movable thereon to a desired location in the attic.

20 Claims, 2 Drawing Sheets

Fig. 3
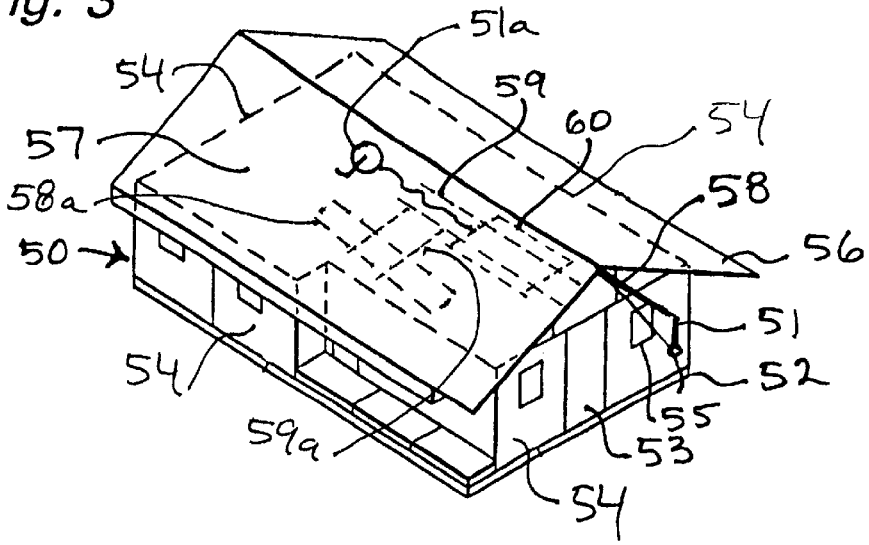
Fig. 4
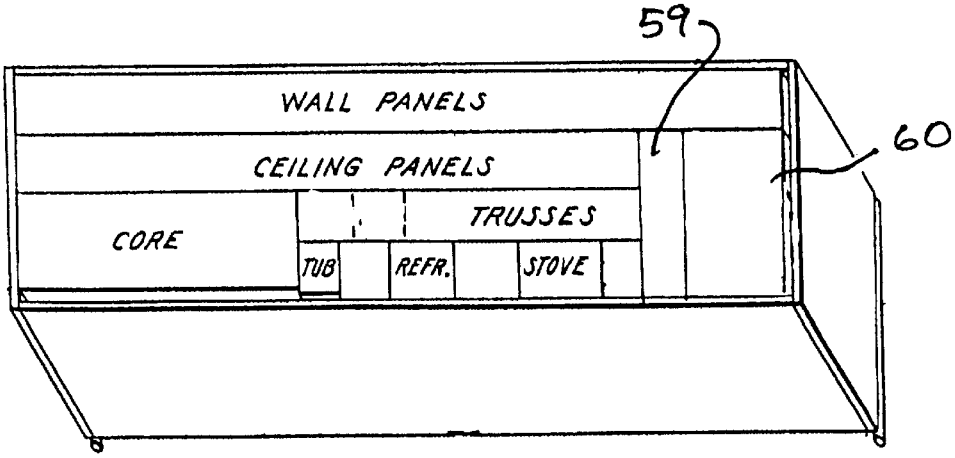
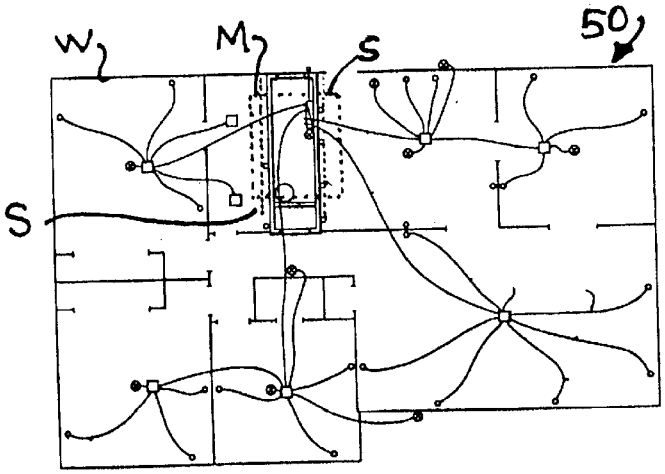
Fig. 5

BUILDING WITH ATTIC MODULE

BACKGROUND OF THE INVENTION

1. Field of the Invention

This invention relates to buildings, to removable modules for a building attic, and, in one particular aspect, to a removable attic, heating, air handling, and/or cooling and/or water handling and/or heating module.

2. Description of Related Art

It is well known in the prior art to locate heating and/or cooling apparatus in the attic of a building. In many cases such apparatus is installed prior to the installation of a roof and/or gable ends of a building. Often in such cases, the heating and/or cooling appartus (for air and/or water) is too large to be removed from a finished, roofed structure since access to the attic is limited to a relatively small door, doors, opening, or openings. Thus, access to the heating and/or cooling apparatus is possible only within the attic. Also, it is often the case that defective apparatus is disconnected and removed to another location in the attic where it is abandoned, rather than being removed from the attic for remanufacture, repair, or sale of scrap.

Relatively small access doors to attics can also present a problem for the use of the attic space as storage. The size of things to be stored can be severely limited to the largest dimension of an access door.

With modular or prefabricated buildings, speed and accuracy of assembly are preferred. Attic modules should be precisely placed for interconnection with other items and structures in the building. Such modules as heating and/or cooling modules should be accessible for repair and removable for replacement.

There has long been a need for a building with easily accessible attic contents. There has long been a need for a building with an attic from which items can be easily removed. There has long been need for a modular or prefabricated building with an easily installable attic module. There has long been a need for a building, prefabricated or otherwise, with easy access to air/water heating/cooling apparatus in an attic.

SUMMARY OF THE PRESENT INVENTION

The present invention, in certain aspects, provides a building with a floor and/or foundation, walls, and an attic beneath a roof or covering, the attic having apparatus one which one or more attic modules are movable both to different locations within the attic itself and into and out of an opening in the attic. In one aspect this apparatus is a series of boards or a platform. In another aspect this apparatus is one or more rails. In particular aspects the modules includes: air cooling apparatus which may or may not be interconnected with and/or in fluid communication with associated items exterior to the attic; air handling apparatus, e.g. fan(s), blower(s), conduits, etc.; air heating apparatus similarly interconnected; water handling apparatus, e.g. pump(s), pipe (s), etc.; water heating apparatus similarly interconnected; intems to be stored; some combination of these; and/or all of these. When a rail or rails are used in the attic, a cooresponding rail follower (or followers) may be used on the bottom of an attic module.

By using an attic module system according to the present invention, it is not necessary for a person to enter an attic to emplace things therein and/or to remove things thereform. Often, moving around in an attic can be dangerous for a person.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient buildings with one or more easily accessible attic modules;

Such a building in which an attic module is movable on one or more boards or rails to a desired location in the attic;

Such a building in which the attic module is easily removable from and/or insertable into the attic through an appropriate opening in a roof, wall, or gable end;

Such a building in which such a module provides additional protected storage in an attic;

Such a building in which the module includes: air heating apparatus; air cooling apparatus; and/or water heating apparatus; and Such a building which is a modular or prefabricated building.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structure, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invetnion which may have other equally effective or legally equivalent embodiments.

FIG. 3 is a perspective partially schematic view of a building according to the present invention.

FIG. 4 is a schematic view of an assembly of parts of a building.

FIG. 5 is a top plan cut-away view of the building of FIG. 1.

DESCRIPTION OF EMBODIMENTS PREFERRED AT THE TIME OF FILING FOR THIS PATENT

Figure 1:
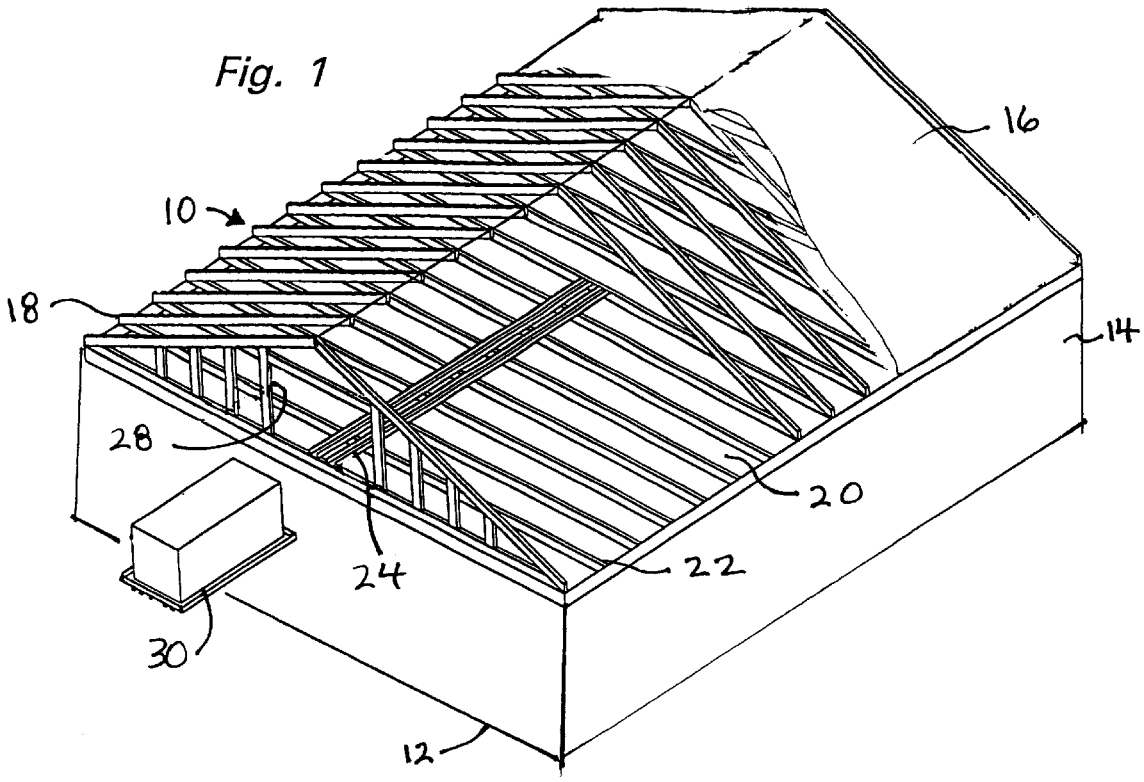
FIG. 1 is a perspective partially schematic view of a building according to the present invention.

FIG. 1 shows a building 10 according to the present invention which has a floor or foundation 12; walls 14 with appropriate doors, windows, etc. (not shown); a roof 16 (shown cut away) over a roof support structure 18 which overlies an attic 20 with an attic floor 22; and a rail system 24 for a removable attic module 30. It is to be understood that the rail system 24 may be installed at any desired location within the attic 20 and that an opening 28 adjacent one end of the rail system 24 may be located anywhere as desired. Appropriate covering or wall material is optionally removably installed over the opening 28. Also there may be multiple rail systems and multiple modules, including multiple modules on a single rail systems. Alternatively one or more boards are used instead of rails.

Figure 2:
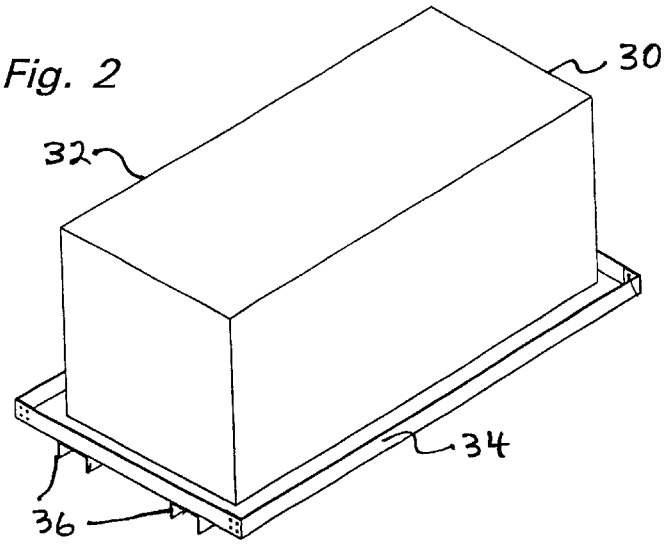
FIG. 2 is a perspective view of an attic module of the building of FIG. 1.

FIG. 2 shows schematically the module 30 which includes a container, housing, or body 32 which may be mounted in a pan 34. The pan 34 is optional and is used when the module contains air or water treating apparatus. Mount members 36 correspond with and are movable on the rail system 24. Mount members 36 are optional. Suitable rollers, wheels, and/or bearings may be used on the module and/or boards or rail system to facilitate module movement thereon. As shown in FIG. 1, the module 30 can be inserted from outside the building 10, through the opening 28, onto the rail system 24 and then moved to a desired location on the rail system 24 within the attic 20.

FIG. 3 shows a prefabricated building 50 with a floor 52, walls 54, a door 53, windows 55, a roof 56, an attic 57, attic openings 58 and 58*a*, rail systems 59 and 59*b* and an attic module 60 (shown in dotted lines schematically, like the module 30 of FIG. 1). A building somewhat similar to that of FIG. 3 is described in prior art U.S. Pat. No. 4,327,529 which is incorporated herein by reference, but which does not teach or suggest an attic module and rail system as disclosed herein. An optional hoist system 51 is usable to raise and lower the attic module to and from the opening 58 and an optional crank system 51*a* may be used to move the attic module on the rail system 59.

FIG. 4 shows a schematic view of a shipping box with its top removed indicating areas in the box for the various components of the building of FIG. 3. In addition to the items disclosed in the box of U.S. Pat. No. 4,327,529, the shipping box for the building 50 includes at least one attic module and a rail system (as the items 60, 59 respectively or as any disclosed herein). Any item included may, optionally, be deleted from the box.

FIG. 5 shows the relative location of an istalled attic module M (any module according to the present invention disclosed herein) in dotted lines with reference to the floor plan of the building 50. The module M is on a rail system S which employs an opening in the wall W. It is within the scope of this invention to install the attic module anywhere in an attic. As shown in FIG. 5, the attic module contains air heating, air cooling, and water heating apparatus and is conveniently installed above a building "core" 62 or "utility core" which, as described in U.S. Pat. No. 4,327,529, can contain conduits for water and sewage connections dor sinks and bathroom, kitchen, and utility areas; associated water heater and air handling and/or conditioning apparatus and/or conduits; and/or an electrical breaker box with associated conduits and connections.

The present invention, therefore, in some, bot not mecessarily all, embodiments, provides a prefabricated building with a plurality of exterior walls joined together, a roof structure overlaying an interior space defined by the plurality of walls, an attic under the roof structure, the attic having an attic floor, at least one module support system on the attic floor, an opening in the prefabricated building located for accessing the at least one module support system, and at least one module insertable through the opening, disposable on the module support system, and movable thereon to a desired location in the attic. Such a building may have one, some (in any possible combination) or all of the following: means for facilitating the at least one module movement on the at least one module support system; wherein the module support system has rails and the means for facilitating module movement includes spaced-apart mount members extending down from the at least one module for disposition on either side of rails of the rail system; wherein the at least one module support system is a plurality of rail system within the attic, each with a corresponding building access opening; wherein the at least one module includes fluid treating apparatus; wherein the fluid treating apparatus is selected from the group consisting of air treatment apparatus, air handling apparatus, and water treatment apparatus; wherein the air treatment apparatus includes air cooling apparatus and air heating apparatus; wherein the at least one module further has a container, and fluid collection pan below the container for collecting fluids from the container; a utility core; wherein the at least one module is positioned above the utility core; wherein the walls, roof structure, at least one module support system, and at least one module are packed in a shipping box; the utility core in the shipping box; and/or wherein the at least one module is a plurality of modules.

The present invention, therefore, in some, but not necessarily all, embodiments, provides a prefabricated building with a plurality of exterior walls joined together, a roof structure overlying an interior space defined by the plurality of walls, an attic under the roof structure, the attic having an attic floor, at least one module support system on the attic floor, an opening in the prefabricated building located for accessing the at least one module support system, at least one module insertable through the opening, disposable on the module support system, and movable thereon to a desired location in the attic, means for facilitating the at least one module movement on the at least one module support system, fluid treating apparatus in the at least one module, the fluid treating apparatus selected from the group consisting of air treatment apparatus, air handling apparatus, and water treatment apparatus, and utility core.

The present invention, therefore, in some, but not necessarily all, embodiments, provides a system for a building having an attic and a building opening, the system with at least one rail apparatus in the attic, at least one module insertable through the building opening onto the at least one rail apparatus for movement thereon.

The present invention, therefore, in some, but not necessarily all, embodiments, provides a method for moving a module into an attic of a building and within the attic of the building, the building having a building opening, the method including inserting the module through the building opening, the building comprising a plurality of exterior walls joined together, a roof structure overlying an interior space defined by the plurality of walls, an attic under the roof structure, the attic having an attic floor, at least one module support system on the attic floor, an opening in the prefabricated building located for accessing the at least one module support system, and at least one module insertable through the opening, disposable on one the module support system, and movable thereon to a desired location in the attic, emplacing the module on the at least one module support system, and moving the module on the at least one module support system to a desired location in the attic. Such a method may include one, some (in any possible combination) or all of the following: moving the module out through the opening to outside the building; wherein the module includes fluid treating apparatus; wherein the building includes a utility core, the method including positioning the module in the attic above the utility core; and/or wherein the building is a prefabricated building.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as leagally possible in whatever form is may be utilized. The invention claimed herein is new and novel in accordance with 35 U.S.C. §102 and satifies the conditions for patentability in § 102. The invention claimed herein is not obvious in accordance with 35 U.S.C. §103 and satisifies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A prefabricated building comprising:

a plurality of exterior walls joined together, a roof structure overlying an interior space defined by the plurality of walls, an attic under the roof structure, the attic having an attic floor, at least one module support system on the attic floor, an opening in the prefabricated building located for accessing the at least one module support system, and at least one module insertable through the opening, disposable on the module support system, and movable thereon to a desired location in the attic.

2. The prefabricated building of claim 1 further comprising:

means for facilitating the at least one module movement on the at least one module support system.

3. The prefabricated building of claim 2 wherein the module support system has rails and the means for facilitating module movement includes spaced-apart mount members extending down from the at least one module for disposition on either side of rails of the rail system.

4. The prefabricated building of claim 1 wherein:

the at least one module support system is a plurality of rail systems within the attic, each with a corresponding building access opening.

5. The prefabricated building of claim 1 wherein the at least one module includes fluid treating apparatus.

6. The prefabricated building of claim 5 wherein the fluid treating apparatus is selected from the group consisting of air treatment apparatus, air handling apparatus, and water treatment apparatus.

7. The prefabricated building of claim 6 wherein the air treatment apparatus includes air cooling apparatus and air heating apparatus.

8. The prefabricated building of claim 6 wherein the at least one module further comprises:

a container, and a fluid collection pan below the container for collecting fluids from the container.

9. The prefabricated building of claim 1 further comprising:

a utility core.

10. The prefabricated building of claim 1 wherein the at least one module is positioned above the utility core.

11. The prefabricated building of claim 1 wherein the walls, roof structure, at least one module support system, and at least one module are packed in a shippinh box.

12. The prefabricated building of claim 11 further comprising the utility core in the shipping box.

13. The prefabricated building of claim 1 further comprising wherein:

the at least one module is a plurality of modules.

14. A prefabricated building comprising:

a plurality of exterior walls joined together, a roof structure overlying an interior space defined by the plurality of walls, an attic under the roof structure, the attic having an attic floor, at least one module support system on the attic floor, an opening in the prefabricated building located for accessing the at least one module support system, at least one module insertable through the opening, disposable on the module support system, and movable thereon to a desired location in the attic, means for facilitating the at least one module movement on the at least one module support system, fluid treating apparatus in the at least one module, the fluid treating apparatus selected from the group consisting of air treatment apparatus, air handling apparatus, and water treatment apparatus, and a utility core.

15. A system for a building having an attic and a building opening, the system comprising:

at least one rail apparatus in the attic, at least one module insertable through the building opening onto the at least one rail apparatus for movement thereon.

16. A method for moving a module into an attic of a building and within the attic of the building, the building having a building opening, the method comprising:

inserting the module through the building opening, the building comprising a plurality of exterior walls joined together, a roof structure overlying an interior space defined by the plurality of walls, an attic under the roof structure, the attic having an attic floor, at least one module support system on the attic floor, an opening in the prefabricated building located for accessing the at least one module support system, and at least one module insertable through the opening, disposable on the module support system, and movable thereon to a desired location in the attic, emplacing the module on the at least one module support system, and moving the module on the at least one module support system to a desired location in the attic.

17. The method of claim 16 further comprising:

moving the module out through the opening to outside the building.

18. The method of claim 16 wherein the module includes fluid treating apparatus.

19. The method of claim 16 wherein the building includes a utility core, the method further comprising:

positioning the module in the attic above the utility core.

20. The method of claim 16 wherein the building is a prefabricated building.

* * * * *